US008038552B2

(12) United States Patent
Song

(10) Patent No.: US 8,038,552 B2
(45) Date of Patent: Oct. 18, 2011

(54) FLETCHING FOR ARROW

(76) Inventor: In-Gyu Song, Busan (KR)

( * ) Notice: Subject to any disclaimer, the term of this patent is extended or adjusted under 35 U.S.C. 154(b) by 281 days.

(21) Appl. No.: 12/510,805

(22) Filed: Jul. 28, 2009

(65) Prior Publication Data

US 2010/0311527 A1 Dec. 9, 2010

(30) Foreign Application Priority Data

Jun. 9, 2009 (KR) ..... 10-2009-0050908

(51) Int. Cl.
*F42B 6/06* (2006.01)

(52) U.S. Cl. ..... 473/586

(58) Field of Classification Search ..... 446/34, 446/57, 58, 59, 61, 62; 473/578, 585, 586
See application file for complete search history.

(56) References Cited

U.S. PATENT DOCUMENTS

| | | | | |
|---|---|---|---|---|
| 2,887,319 | A * | 5/1959 | Lay | 473/586 |
| 3,952,448 | A * | 4/1976 | Kabchef | 446/59 |
| 6,280,279 | B1 * | 8/2001 | Tanger et al. | 446/34 |
| 6,695,727 | B1 * | 2/2004 | Kuhn | 473/586 |
| 6,958,023 | B2 * | 10/2005 | Simo et al. | 473/586 |

* cited by examiner

*Primary Examiner* — John Ricci
(74) *Attorney, Agent, or Firm* — Birch, Stewart, Kolasch & Birch, LLP

(57) ABSTRACT

Disclosed herein is fletching for an arrow, which is light and displays sufficient air resistance, thus ensuring the linear travel and stability of the flight of the arrow, being easy to attach to a shaft, and reliably maintaining the shape of the fletching. The fletching includes a wing part and an adhesive part. The wing part includes a frame formed such that an inside portion of an outer edge thereof is open and defining an overall structure, a plurality of vertical ribs connecting upper and lower portions of the frame to each other and arranged to be spaced apart from each other in a longitudinal direction of the frame, and a thin film provided in an empty space defined by the frame and each of the vertical ribs. The adhesive part is provided on the lower end of the wing part and attached to a shaft.

5 Claims, 4 Drawing Sheets

FLETCHING FOR ARROW

BACKGROUND OF THE INVENTION

1. Field of the Invention

The present invention relates generally to fletching for an arrow and, more particularly, to fletching for an arrow which is lighter than conventional fletching, ensures in-flight stability and linear travel of the arrow, and imparts a pitch to a wing part in advance to allow the fletching to be easily mounted to a shaft.

2. Description of the Related Art

An arrow is a projectile which straddles the string of a bow or crossbow to be shot therefrom, and includes a shaft, a pile, fletching and a nock. The pile is provided on the front end of the shaft, and the nock is provided on the rear end of the shaft to straddle the string of the bow or crossbow. Generally, the arrow which has been shot from the string of the bow or crossbow flies to a target while describing a parabola. At this time, the arrow flies while rolling and pitching with respect to the center of gravity of the arrow. That is, the arrow does not fly straight towards a target but flies unsteadily as if it were a swimming fish. This is referred to as the arrow paradox. The fletching of the arrow functions to overcome the unsteady motion, thus allowing the arrow to fly straight using air resistance. Further, the arrow flies while being rotated by air resistance acting on the fletching of the arrow. The directionality of the rotating arrow is much more stable than that of an arrow which does not rotate. That is, a small pitch is imparted to the fletching mounted to the shaft to rotate the arrow, thus ensuring the stable movement of the arrow. Such an effect is called a gyro effect.

FIG. 10 is a side view illustrating conventional fletching for an arrow. The conventional fletching 10 includes a wing part 11 having a plate shape, and an adhesive part 12 which is provided on the lower end of the wing part and used to attach the fletching 10 to a shaft.

FIG. 11 is a plan view illustrating part of the arrow, in which the conventional fletching is mounted to the shaft. As shown in the drawing, the conventional fletching 10 is attached to the outer circumference of a shaft 20. Generally, two to four feathers constituting the fletching 10 are attached to the outer circumference of the shaft to be spaced apart from each other at regular intervals in the circumferential direction thereof. Here, in order to use the gyro effect of the arrow, a predetermined pitch is imparted to the fletching 10, thus allowing the arrow to rotate while in flight. That is, when the fletching 10 is attached to the shaft 20, as shown in the drawing, the adhesive part 12 is not attached straight along the central axis of the shaft 20 in a longitudinal direction thereof, but is twisted and attached such that the adhesive part 12 deviates slightly from the central axis. Through such an attaching method, the side of the wing part 11 of the fletching 10 is slightly curved, thus serving as a pinwheel that allows the arrow to rotate when the arrow is in flight. However, the conventional fletching is problematic in that a worker or user must manually impart a pitch to the fletching 10, so that it takes a long time and is very difficult to impart the pitch. In other words, since the same amount of pitch is imparted to two to four feathers mounted to the shaft 20, it is difficult to precisely attach each feather to the shaft 20 in a constant pitch.

Further, recently, as the weight of the shaft shows a tendency towards reduction, light fletching is required, and besides, the development and supply of fletching for an arrow which is capable of maintaining air resistance and rotary force acting on the fletching to a proper level are needed.

SUMMARY OF THE INVENTION

Accordingly, the present invention has been made keeping in mind the above problems occurring in the prior art, and an object of the present invention is to provide fletching for an arrow, which maintains a predetermined shape, realizes lightness, and controls the flow of air acting on the fletching to a proper level, thus ensuring in-flight stability and linear travel of the arrow, and which previously imparts a pitch to the fletching, thus allowing the fletching to be easily mounted to a shaft.

In order to accomplish the above object, the present invention provides a fletching for an arrow including a wing part and an adhesive part. The wing part includes a frame formed such that an inside portion of an outer edge thereof is open and defining an overall structure, a plurality of vertical ribs connecting upper and lower portions of the frame to each other and arranged to be spaced apart from each other in a longitudinal direction of the frame, and a thin film provided in an empty space defined by the frame and each of the vertical ribs. The adhesive part is provided on a lower end of the wing part and attached to a shaft.

A plurality of horizontal ribs may be provided on the wing part to connect the plurality of vertical ribs to each other.

The horizontal ribs may be arranged to alternate with each other.

A side of the wing part may be curved at a predetermined angle by tension of the vertical ribs which connect the upper and lower portions of the frame to each other.

The thin film may be thinner than the frame, the vertical ribs and the horizontal ribs, and furthermore the vertical ribs may be thicker than the horizontal ribs.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Hereinafter, the construction and operational principle of the present invention will be described in detail with reference to the accompanying drawings.

Figure 1:
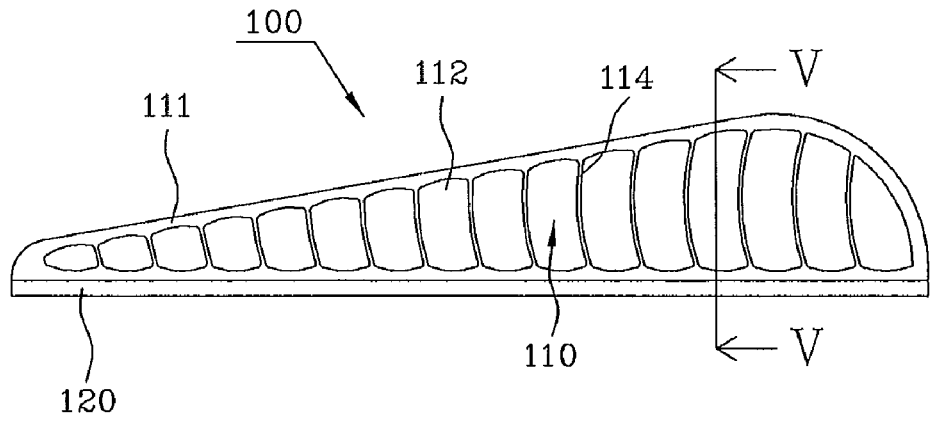
FIG. 1 is a side view illustrating fletching for an arrow according to a first embodiment of the present invention.
Figure 5:
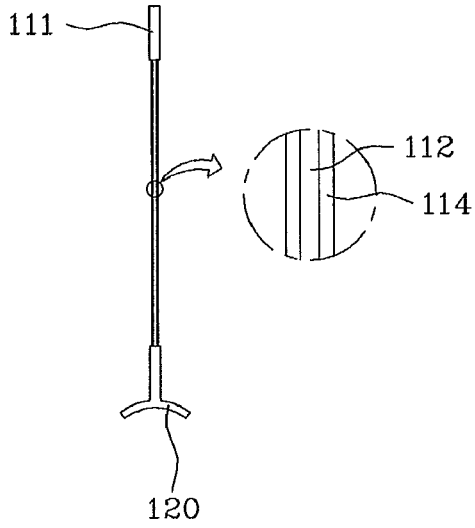
FIG. 5 is a vertical sectional view taken along line V-V of FIG. 1.

FIG. 1 is a side view illustrating fletching for an arrow according to a first embodiment of the present invention, and FIG. 5 is a vertical sectional view taken along line V-V of FIG. 1. Fletching 100 for an arrow according to the present invention includes a wing part 110 which guides air resistance and imparts rotary force to a shaft, and an adhesive part 120 which is used to attach the wing part 110 to the shaft.

Unlike a conventional wing part which is made of a simple plate material, the wing part 110 includes a frame 111 which is formed such that the inside portion of its outer edge is open, thus defining an overall structure of the wing part 110, a plurality of vertical ribs 114 which connect the upper and lower portions of the frame 111 to each other and are arranged from the front of the fletching to the rear thereof in such a way as to be spaced apart from each other, and thin films 112.

The frame 111 is formed to have a predetermined thickness using a material such as resin, and may be made of hard or soft resin having elasticity which is sufficient to maintain the entire shape of the wing part 110.

The vertical ribs 114 correspond to the muscle of the wing part 110, and are preferably made of the same material as the frame 111 to be connected to the upper and lower portions of the frame 111. However, if necessary, the vertical ribs 114 may be made of a material different from that of the frame 111.

Figure 2:
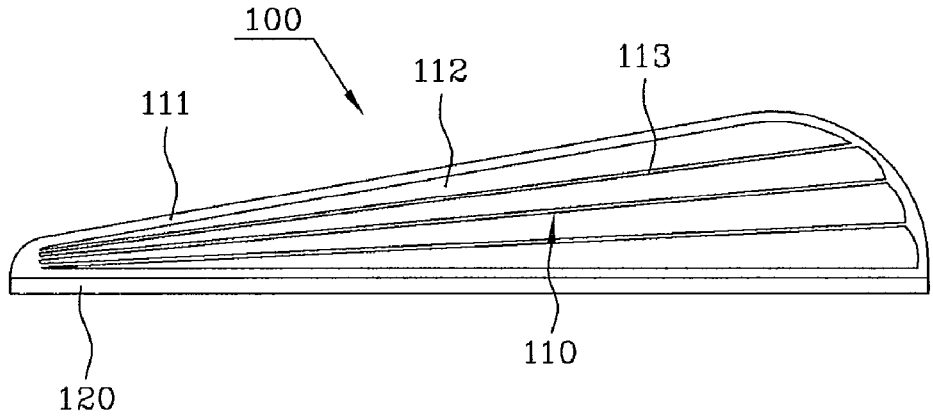
FIG. 2 is a side view illustrating fletching for an arrow according to a second embodiment of the present invention.

FIG. 2 is a side view illustrating fletching for an arrow according to a second embodiment of the present invention. Unlike the above embodiment, a wing part 110 includes a frame 111 which defines an overall structure of the wing part 110, a plurality of horizontal ribs 113 which connect the left and right portions of the frame 111 to each other and are arranged from the upper portion of the fletching to the lower portion thereof in such a way as to be spaced apart from each other, and thin films 112. Similarly to the vertical ribs 114, the horizontal ribs 113 may be made of the same material as the frame 111 or made of a material different from that of the frame 111.

Figure 3:
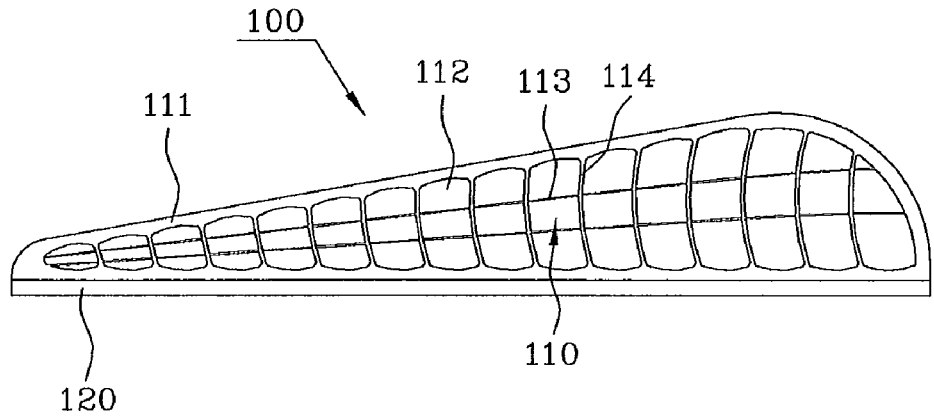
FIG. 3 is a side view illustrating fletching for an arrow according to a third embodiment of the present invention.

FIG. 3 is a side view illustrating fletching for an arrow according to a third embodiment of the present invention. According to this embodiment, in addition to the vertical ribs 114, the fletching includes a plurality of horizontal ribs 113 which connect the frame 111 to the vertical ribs 114 or connect vertical ribs 114 to each other. That is, the fletching additionally includes the horizontal ribs 113 which connect vertical ribs 114, selected from the plurality of vertical ribs 114 which are arranged from the front portion of the fletching 100 to the rear portion thereof, to each other. As such, in the case of forming the horizontal ribs 113 which connect the vertical ribs 114 to each other or connect the vertical ribs 114 to the frame 111, the shape of the wing part 110 can be more effectively maintained.

Figure 4:
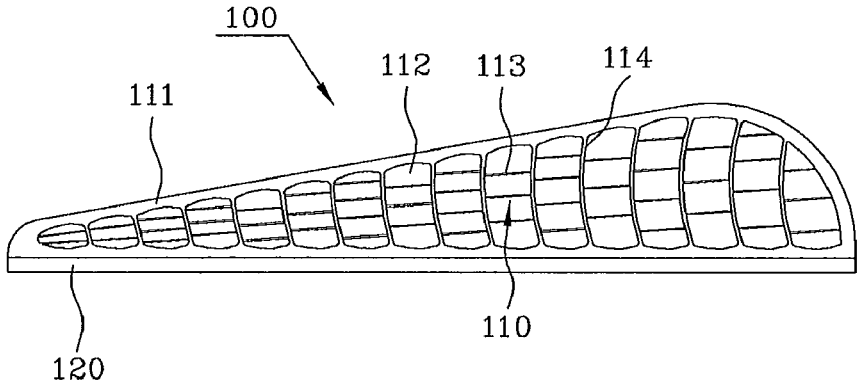
FIG. 4 is a side view illustrating fletching for an arrow according to a fourth embodiment of the present invention.

FIG. 4 is a side view illustrating fletching for an arrow according to a fourth embodiment of the present invention. According to this embodiment, horizontal ribs 113 are not arranged in the form of continuous straight lines, but are arranged such that the horizontal ribs 113 alternate with each other. That is, the horizontal ribs 113 connecting the vertical ribs 114 to each other are not arranged on the same line but are arranged to alternate with each other, unlike the third embodiment. Such an arrangement improves the flow of air acting on the fletching 100 when the arrow is shot.

Each thin film 112 is provided at an area in the wing part 110 in which the frame 111, the horizontal ribs 113 and the vertical ribs 114 are not located. That is, the thin films 112 are provided in empty space which is defined by the frame 110, the horizontal ribs 113 and the vertical ribs 114 to be connected to the frame 111, the horizontal ribs 113 and the vertical ribs 114. Preferably, each thin film 112 is very thin and made of transparent or semi-transparent resin.

The thickness of respective components of the wing part 110 is as follows. That is, preferably, the frame 111 is the thickest, and the thickness is reduced in the sequence of the vertical rib 114, the horizontal rib 113, and the thin film 112. This forms turbulence in the air flowing along the fletching when the arrow flies, thus preventing the arrow from rolling and pitching with respect to the center of gravity of the arrow, therefore ensuring the stable flight and linear travel of the arrow.

The adhesive part 120 may be made of the same resin as the wing part 110 or resin different from that of the wing part 110, and an adhesive is applied to the bottom of the adhesive part 120 so that it is attached to the outer circumference of the shaft.

Figure 6:
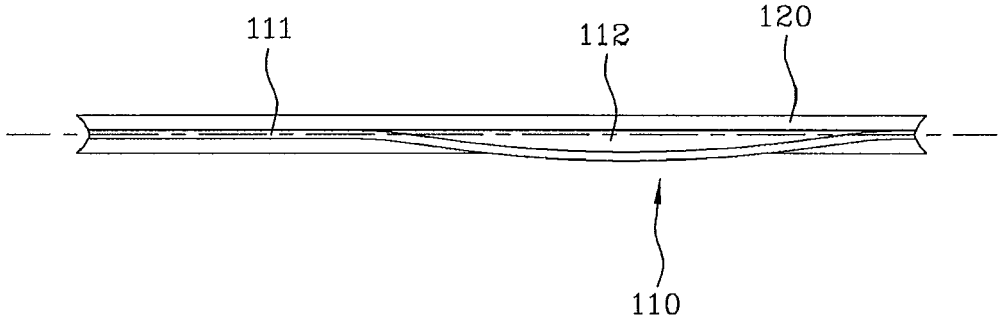
FIG. 6 is a plan view of FIG. 1.
Figure 7:
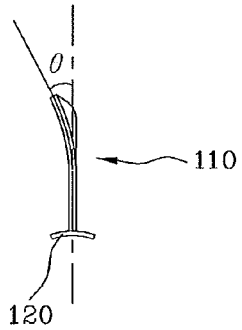
FIG. 7 is a rear view of FIG. 1.

FIG. 6 is a plan view of FIG. 1, and FIG. 7 is a rear view of FIG. 1. According to the present invention, it is possible to impart a predetermined pitch to the wing part 110 in advance before the fletching is attached to the shaft, by curving the wing part 110 of the fletching. In the conventional fletching, the wing part is formed of a single material, that is, soft resin to have the flat surface of a plate shape. Thus, it is impossible to curve the wing part and impart a pitch to the wing part in advance. Further, although the wing part is curved so that a pitch is imparted to the wing part in advance, the wing part is undesirably restored to its original shape due to the soft material. However, according to the present invention, the length and elasticity of the horizontal rib 113 and the vertical rib 114 can be adjusted so that the wing part 110 is curved at a predetermined angle and a pitch is imparted to the wing part 110 in advance. For example, if the vertical rib 114 connecting the upper and lower portions of the frame 111 with each other is formed to be shorter than a spacing distance between the upper and lower portions of the frame 111, the upper portion of the frame 111 is elastically pulled by the vertical rib 114, so that the upper portion of the wing part 110 is curved. Further, when the left side of the drawings is designated as the front portion and the right side of the drawings is designated as the rear portion, the curved portion of the wing part 110 is changed depending on whether the length of the vertical rib 114 on the front portion of the frame 111 is adjusted or the length of the vertical rib 114 on the rear portion of the frame 111 is adjusted. Thus, by appropriately adjusting the length and tension of the vertical rib 114 and the horizontal rib 113, the wing part 110 may be changed in a variety of shapes.

Figure 8:
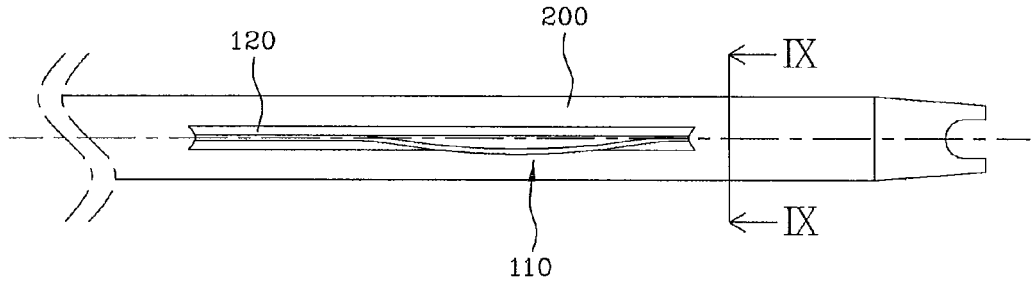
FIG. 8 is a plan view illustrating part of an arrow, in which the fletching of the present invention is mounted to a shaft.
Figure 9:
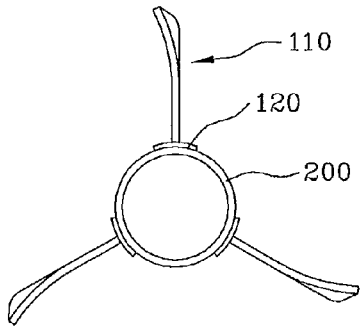
FIG. 9 is a cross-sectional view taken along line IX-IX of FIG. 8.
Figure 10:
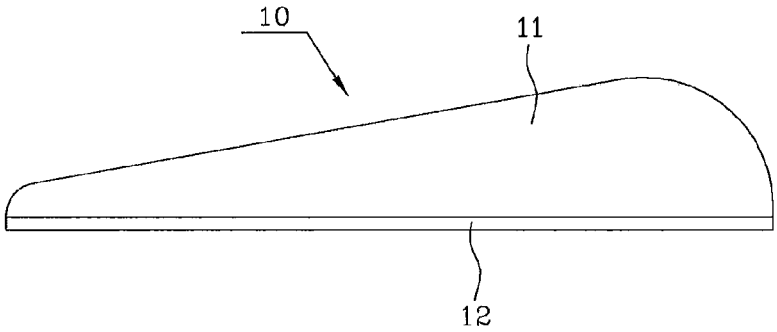
FIG. 10 is a side view illustrating conventional fletching for an arrow.
Figure 11:
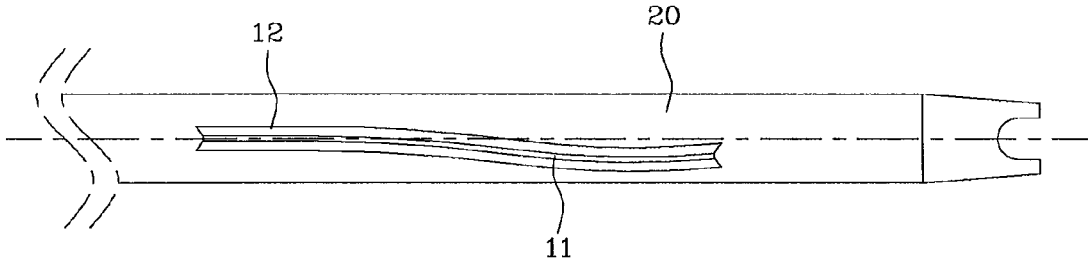
FIG. 11 is a plan view illustrating part of an arrow, in which the conventional fletching is mounted to a shaft.

FIG. 8 is a plan view illustrating part of an arrow, in which the fletching of the present invention is mounted to a shaft, and FIG. 9 is a cross-sectional view taken along line IX-IX of FIG. 8. According to the present invention, the fletching 100 is formed such that the side of the wing part 110 is curved by the tension of the vertical rib 114 or the horizontal rib 113. Thus, when the fletching 100 is mounted to the shaft 200, it is unnecessary to twist the adhesive part 120 such that it is inclined with respect to the central axis of the shaft 200 in its longitudinal direction, unlike the conventional fletching. According to the present invention, as shown in FIG. 8, a user has only to attach the fletching 100 in a straight line such that the central line of the adhesive part 120 corresponds to the central axis of the shaft 200. At this time, a pitch is naturally imparted to the fletching 100. Thus, it is simple for a worker or user to attach the fletching 100 to the shaft 200, and two or four feathers have the same pitch, so that the rotating ability of the arrow is improved. Owing to the feathers having the same pitch, the arrow can fly more stably, so that the linear travel of the arrow is ensured, rotary force becomes uniform, and the speed of the arrow increases.

For the sake of convenience, in the embodiments of the present invention, a component extending from the upper portion of the frame 111 to the lower portion thereof is referred to as the vertical rib 114, and a component extending from the left side of the frame 111 to the right side thereof is referred to as the horizontal rib 113. However, it should not be interpreted that the terms mean the vertical and the horizontal. That is, it should be interpreted that the vertical rib 114 means the rib which extends from an upper position to a lower position, and the horizontal rib 113 means the rib which extends from a left side to a right side.

As described above, the present invention provides fletching for an arrow, which maintains a constant shape and ensures durability, in addition to realizing lightness. Further, it is possible to impart a pitch to the fletching in advance and maintain the imparted pitch. When the fletching is attached to a shaft, an operation of artificially imparting a pitch may be omitted, thus being very convenient. Furthermore, owing to the structure of a horizontal rib, a vertical rib and a thin film provided on the wing part of the fletching, air resistance or rotary force acting on the fletching is improved, thus ensuring the stability in flight and linear travel of the arrow.

What is claimed is:

1. Fletching for an arrow, comprising:

a wing part, including:

a frame formed such that an inside portion of an outer edge thereof is open, and defining an overall structure;

a plurality of vertical ribs connecting upper and lower portions of the frame to each other, and arranged to be spaced apart from each other in a longitudinal direction of the frame; and a thin film provided in an empty space defined by the frame and each of the vertical ribs; and an adhesive part provided on a lower end of the wing part, and attached to a shaft.

2. The fletching as set forth in claim 1, wherein a plurality of horizontal ribs is provided on the wing part to connect the plurality of vertical ribs to each other.

3. The fletching as set forth in claim 2, wherein the horizontal ribs are arranged to alternate with each other.

4. The fletching as set forth in any one of claims 1 to 3, wherein a side of the wing part is curved at a predetermined angle by tension of the vertical ribs which connect the upper and lower portions of the frame to each other.

5. The fletching as set forth in claim 4, wherein the thin film is thinner than the frame, the vertical ribs and the horizontal ribs, and furthermore the vertical ribs are thicker than the horizontal ribs.

* * * * *